US005472200A

United States Patent [19]

Miller

[11] Patent Number: 5,472,200

[45] Date of Patent: Dec. 5, 1995

[54] GOLF BALL KICKING DEVICE

[76] Inventor: George A. Miller, 4406 Windy Oaks Rd., Louisville, Ky. 40241

[21] Appl. No.: 243,457

[22] Filed: May 16, 1994

[51] Int. Cl.[6] ..... A63B 69/36; A63B 53/00

[52] U.S. Cl. ..... 273/162 R; 273/167 R; 273/77 A; 273/67 B; 36/133

[58] Field of Search ..... 273/67 B, 77 A, 273/167 R, 162 R, 32 R, 32 B, 35 R; 36/127, 132, 133

[56] References Cited

U.S. PATENT DOCUMENTS

| | | | |
|---|---|---|---|
| 2,220,291 | 11/1940 | Savoy | 273/67 B X |
| 2,269,357 | 1/1942 | Dent | 273/67 B |
| 3,851,410 | 12/1974 | Frazier | 36/133 |
| 4,073,075 | 2/1978 | O'Brien | 36/127 |
| 4,422,249 | 12/1983 | Hannah | 36/133 |
| 4,693,022 | 9/1987 | Terhune | 36/132 |
| 5,109,617 | 5/1992 | Nummy | 36/132 |

*Primary Examiner*—George J. Marlo
*Attorney, Agent, or Firm*—Camoriano & Smith

[57] ABSTRACT

A golf ball kicking device adapted to be worn on the toe of a shoe comprising a first member having a concavity including a flexible surface adapted to be positioned against a toe of a shoe;

a second member detachably connected to said first member and having a golf ball striking surface adapted to be mounted in front of the toe of the shoe, said striking surface having an area approximating the area of a selected golf iron and a slope approximating the slope of said selected golf iron; and an adjustable strap fastened at opposite ends thereof to the first member for maintaining said first member in a fixed and abutting relationship with said toe of said shoe.

2 Claims, 2 Drawing Sheets

GOLF BALL KICKING DEVICE

BACKGROUND OF THE INVENTION

This invention relates to a golf ball kicking device that can be removably positioned on the toe of a shoe and used for striking and directing golf balls in a manner similar to a selected golf club.

Games abound in which the participants use apparatus guided by the hands and arms to propel a ball or an object in a desired direction. Less common are games in which the feet are provided with apparatus to direct the movement of an object. Games such as american football and soccer may use shoes having special configurations to help guide the football or soccer ball. Golf, for example, is played solely with clubs guided by the hands even when playing the extremely popular version known as miniature golf. However, there are apparently no apparatus specially designed to be worn on a participant's shoe that can be used to direct the movement of an extremely hard object such as a golf ball. Yet playing a game resembling golf using one's feet, lofting the ball in a short flight or putting can be a pleasurable pursuit.

Thus, for the foregoing reason, there is a need for a game device that could be worn over the toe of a shoe of a participant that would permit the propelling of a golf ball in a manner similar to that of the game of golf through the use of the feet of the participant. There is an additional need for a game device adapted to be worn over the toe of a shoe that can be easily removed and replaced by a similar device having a different version such as a more sloped striking blade to provide a different direction or loft to the striked golf ball.

SUMMARY OF THE INVENTION

A golf ball kicking device comprises a golf ball striking element having a blade with a contour, slope and surface configuration similar to a selected golf iron and a toe enclosing element secured to the striking element. The toe element defines an opening complimentary to and adapted to accept the toe of a shoe in an abutting relationship with the interior surface of the toe element. A fastening element connected to the toe element secures the device and the interior surface of the toe element into the abutting relationship with the toe of the shoe.

BRIEF DESCRIPTION OF THE DRAWING

The present invention will be better understood from the following detailed description of the preferred embodiment of the present invention when considered in connection with the accompanying drawing in which.

DESCRIPTION OF THE PREFERRED EMBODIMENT

Figure 1:
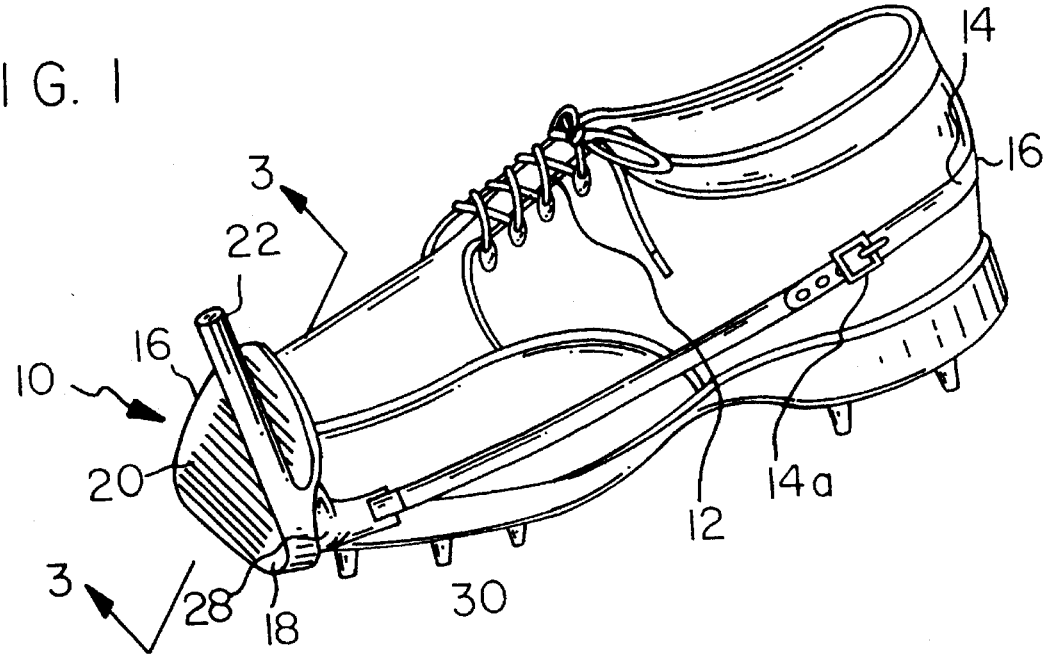
FIG. 1 is a perspective of a golf ball kicking device in accordance with the present invention in which the golf device is secured to a golf shoe by an adjustable strap.

The golf ball kicking device of the present invention is best described in connection with FIGS. 1, 2 and 3. As seen in FIG. 1, the golf device 10 is mounted on a golf shoe 12 and secured thereto by a strap 14 which may be adjustable via buckle 14*a* for different lengths of shoes 12 and is looped about the heel area 16 thereof. Device 10, in part, is comprised of a blade element 16 which provides the surface 18 for striking a golf ball. Element 16 may have a contour shaped like a selected golf iron such as a wedge, for example. Additionally, surface 18 may be provided with lines 20 similar to that found on the striking blade of the selected golf iron to promote friction and loft. A decorative short length of a shaft 22 is optional with the device of the present invention but can provide during use of the device the advantage of demonstrating the slope angle of the blade element 16 and its surface 18 as it strikes a golf ball.

Device 10 also has a second element 24 (integral to element 16 in this embodiment) designed to fit about the contour of a toe of shoe 12. As illustrated in FIG. 2, element 24 has a concave opening 26 defined by dashed lines and is complimentary in shape to a toe of a typical shoe. The opposite side walls 28 of element 24 extend to distal ends 30 each having eyelets 32 for the ends of adjustable strap 14. Side walls 28 are preferably sufficiently flexible to accommodate different widths of shoes 12 that may be inserted therebetween.

Figure 3:
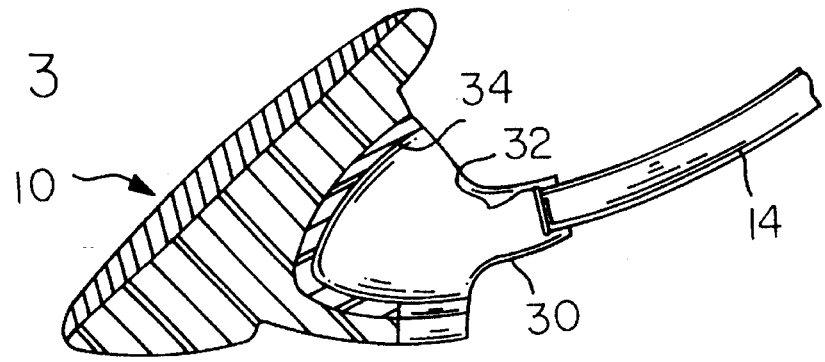
FIG. 3 is a sectional view of the golf device of FIG. 1 taken along lines 3—3.

As illustrated in FIG. 3, the inner surface of opening 26 may be lined with a flexible material 34 such as an open celled polyolefin to accommodate various sizes of shoes 12. The blade element 16 and toe fitting element 24 may made of any desired material such as a cast metal of a composition used in actual golf irons or preferably a durable plastic material in a form obtained through an injection molding process. Plastic material such as polyolefins or polyurethanes may be used.

Figure 4:
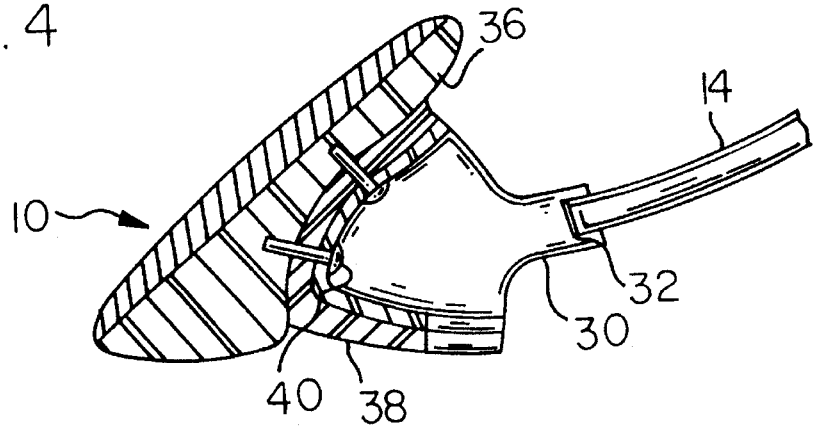
FIG. 4 is sectional view of another embodiment in accordance with the present invention in which the golf device is made in two separate pieces secured together by removable fasteners.

For economy it is preferred that elements 16 and 24 be made integral. However, in some instances, it may be desirable to make the elements separately so that different blades may be mounted on the shoe. The embodiment shown in FIG. 4 illustrates a blade element 36 and a toe fitting element 38 which are secured together by removable fasteners 40. This permits the disassemble and substitution of other blades as desired.

Figure 2:
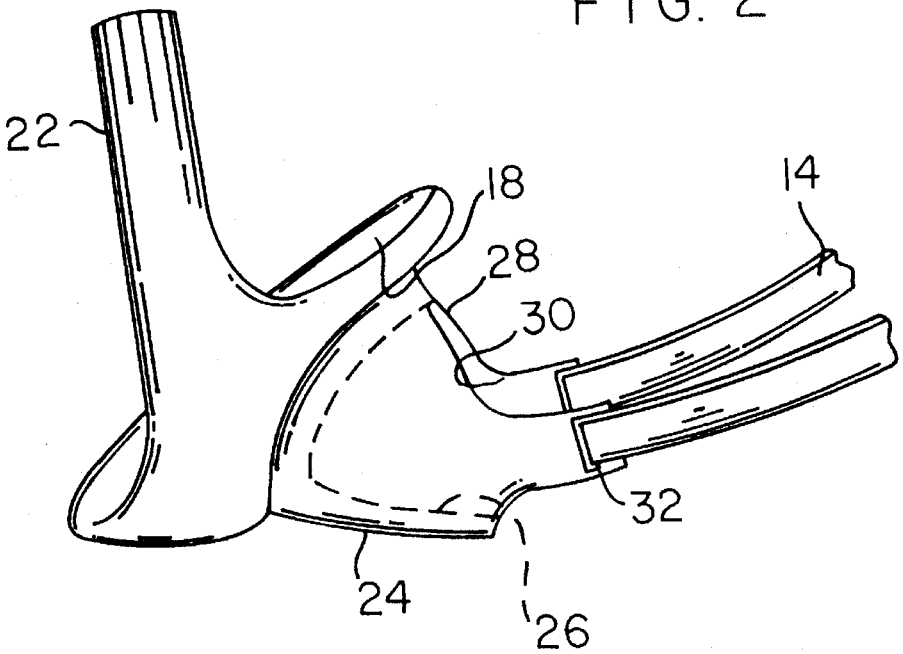
FIG. 2 is a side view of the golf device of FIG. 1.
Figure 5:
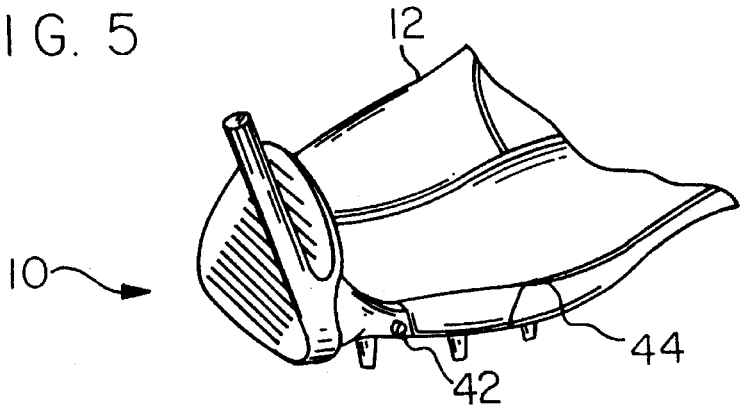
FIG. 5 is a perspective view of a golf device in accordance with the present invention in which the device is secured to a golf shoe by a plurality of set screws.

While the embodiment of FIGS. 1, 2 and 3 illustrate the use of an adjustable strap, preferably elastomeric to fit all sizes, in some instances it may be desirable to use a fastening element such as illustrated in FIG. 5. Distal ends 30 of side walls 28 may each be provided with a set screw 42 that can be secured against the soles 44 of shoe 12.

While the present invention has been described with the preferred embodiment as the focus, it will be appreciated that various changes and modifications can be made, for example, to provide other designs without departing from the intended scope and spirit of the claims.

We claim:

1. A golf ball kicking device adapted to be worn on the toe of a shoe comprising a first member having a concavity including a surface adapted to be positioned against a toe of a shoe, said concavity being defined by a flexible material sufficient to enclose and abut a range of sizes of toes of shoes;

a second member detachably connected to said first member and having a golf ball striking surface adapted to be mounted in front of the toe of the shoe, said striking surface having an area approximating the area of a selected golf iron and a slope approximating the slope of said selected golf iron; and an adjustable strap fastened at opposite ends thereof to said first member and adapted to be looped around the back side of a shoe for maintaining said first member in a fixed and abutting relationship with said toe of said shoe.

2. The device of claim 1 including another second member having a different blade area and slope which may be substituted for said first mentioned second member.

* * * * *